US010003158B2

(12) United States Patent
Hsieh

(10) Patent No.: US 10,003,158 B2
(45) Date of Patent: Jun. 19, 2018

(54) LAN CONNECTOR WITH UNLOCKING PREVENTING MECHANISM

(71) Applicant: 3M INNOVATIVE PROPERTIES COMPANY, St. Paul, MN (US)

(72) Inventor: Shuo-Hsuan Hsieh, Kaohsiung (TW)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days. days.

(21) Appl. No.: 15/304,911

(22) PCT Filed: Apr. 24, 2015

(86) PCT No.: PCT/US2015/027472

§ 371 (c)(1),
(2) Date: Oct. 18, 2016

(87) PCT Pub. No.: WO2015/171332

PCT Pub. Date: Nov. 12, 2015

(65) Prior Publication Data

US 2017/0207574 A1 Jul. 20, 2017

Related U.S. Application Data

(60) Provisional application No. 61/988,401, filed on May 5, 2014.

(51) Int. Cl.
*H01R 13/627* (2006.01)
*H01R 13/639* (2006.01)
(Continued)

(52) U.S. Cl.
CPC ..... *H01R 13/639* (2013.01); *H01R 13/506* (2013.01); *H01R 13/6275* (2013.01); *H01R 24/64* (2013.01); *H01R 2201/04* (2013.01)

(58) Field of Classification Search
CPC ..... H01R 13/6271; H01R 13/6275; H01R 13/6272
(Continued)

(56) References Cited

U.S. PATENT DOCUMENTS 3,470,524 A 9/1969 Culver
6,533,601 B2 * 3/2003 Raudenbush ..... H01R 13/6272 439/352
(Continued)

FOREIGN PATENT DOCUMENTS

CN 203150816 8/2013
WO WO 2013-063233 5/2013

OTHER PUBLICATIONS

International Search Report for PCT International Application No. PCT/US2015/027472 dated Jul. 7, 2015, 3 pages.

*Primary Examiner* — Abdullah Riyami
*Assistant Examiner* — Thang Nguyen
(74) *Attorney, Agent, or Firm* — Clifton F. Richardson

(57) ABSTRACT

A connector including a first channel, a latching member and a second channel. A portion of the latching member is slidably attached to the first channel. The second channel is configured to align with the first channel or to misalign with the first channel. When the second channel is aligned with the first channel, the latch member is allowed to latch with and unlatch from a mating connector. When the second channel is misaligned with the first channel, the latching member is prevented from latching with and unlatching from a mating connector.

32 Claims, 13 Drawing Sheets

(51) Int. Cl.
*H01R 13/506* (2006.01)
*H01R 24/64* (2011.01)

(58) Field of Classification Search
USPC ..... 439/352, 354
See application file for complete search history.

(56) References Cited

U.S. PATENT DOCUMENTS

| | | | | |
|---|---|---|---|---|
| 7,494,363 | B1 * | 2/2009 | Wu | H01R 13/6275 439/352 |
| 8,529,284 | B1 | 9/2013 | Smith | |
| 8,979,569 | B2 * | 3/2015 | Aekins | H01R 24/64 439/352 |
| 9,500,817 | B2 * | 11/2016 | Coffey | G02B 6/36 |
| 2007/0077806 | A1 | 4/2007 | Martin | |
| 2011/0045683 | A1 | 2/2011 | Foung | |
| 2011/0222819 | A1 * | 9/2011 | Anderson | G02B 6/3825 385/78 |
| 2014/0038447 | A1 * | 2/2014 | Brown | H01R 13/62 439/350 |

* cited by examiner

LAN CONNECTOR WITH UNLOCKING PREVENTING MECHANISM

BACKGROUND

Connectors, such as electrical connectors, are used to connect cables to various devices. Connectors are sometimes accidentally detached from a connected device. A need exists for a connector that prevents accidental detachment.

SUMMARY

In some aspects, a connector consistent with the present description includes a first body, a second body and a latching member. The first body includes a mating end of the connector for mating with a mating connector and a first channel extending along a mating direction of the connector. The second body includes a rear end of the connector opposite the mating end for receiving a cable and a second channel extending along the mating direction. The latching member is disposed along the mating direction and includes a fixed end fixedly attached to the connector body proximate the mating end, a sliding end slidably attached to the first channel proximate the rear end, and an elongated latching arm joining the fixed end to the sliding end. The connector also includes a latch portion extending from the latching arm for latching with and unlatching from a mating connector. The second body is configured to move relative to the first body between first and second states. When the second body is in the first state, the second channel is aligned with the first channel so that when the latching arm is pressed, the sliding end slides into the second channel allowing the latch portion to latch with and unlatch from a mating connector. When the second body is in the second state, the second channel is misaligned with the first channel, so that when the latching arm is pressed the sliding end is prevented from sliding into the second channel preventing the latch portion from latching with and unlatching from a mating connector.

In some aspects, a connector consistent with the present description includes a first channel, a latching member and a second channel. A portion of the latching member is slidably attached to the first channel. The second channel is configured to align with the first channel to form a continuous channel allowing the latch member to latch with and unlatch from a mating connector, and to misalign with the first channel preventing the latching member from latching with and unlatching from a mating connector. The connector may be an electrical connector or a fiber optic connector. The connector may include a first body, which includes the first channel, and a second body, which includes the second channel, adjacent to the first body.

DETAILED DESCRIPTION

Figure 1A:
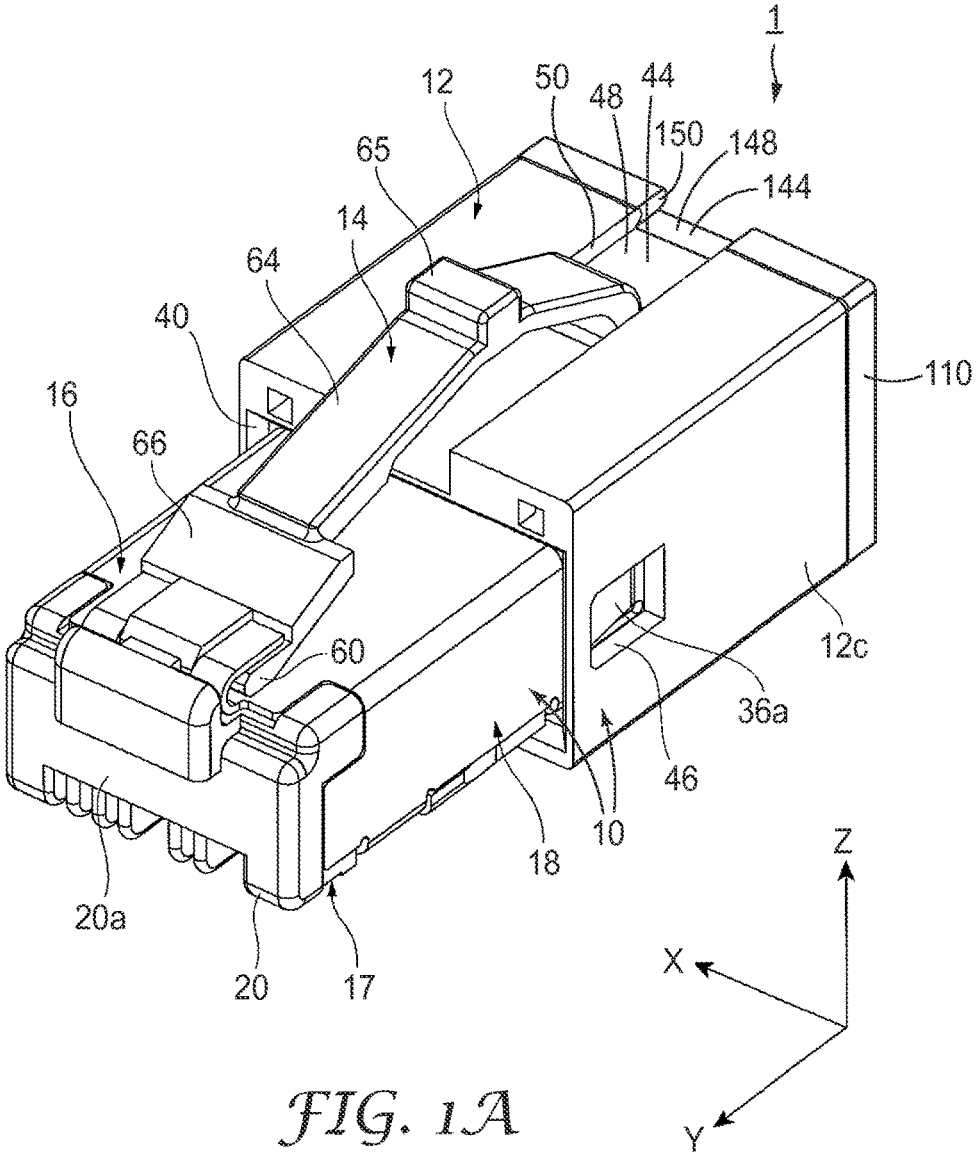
FIG. 1A is a perspective view of a connector having a second body in a first state.
Figure 1B:
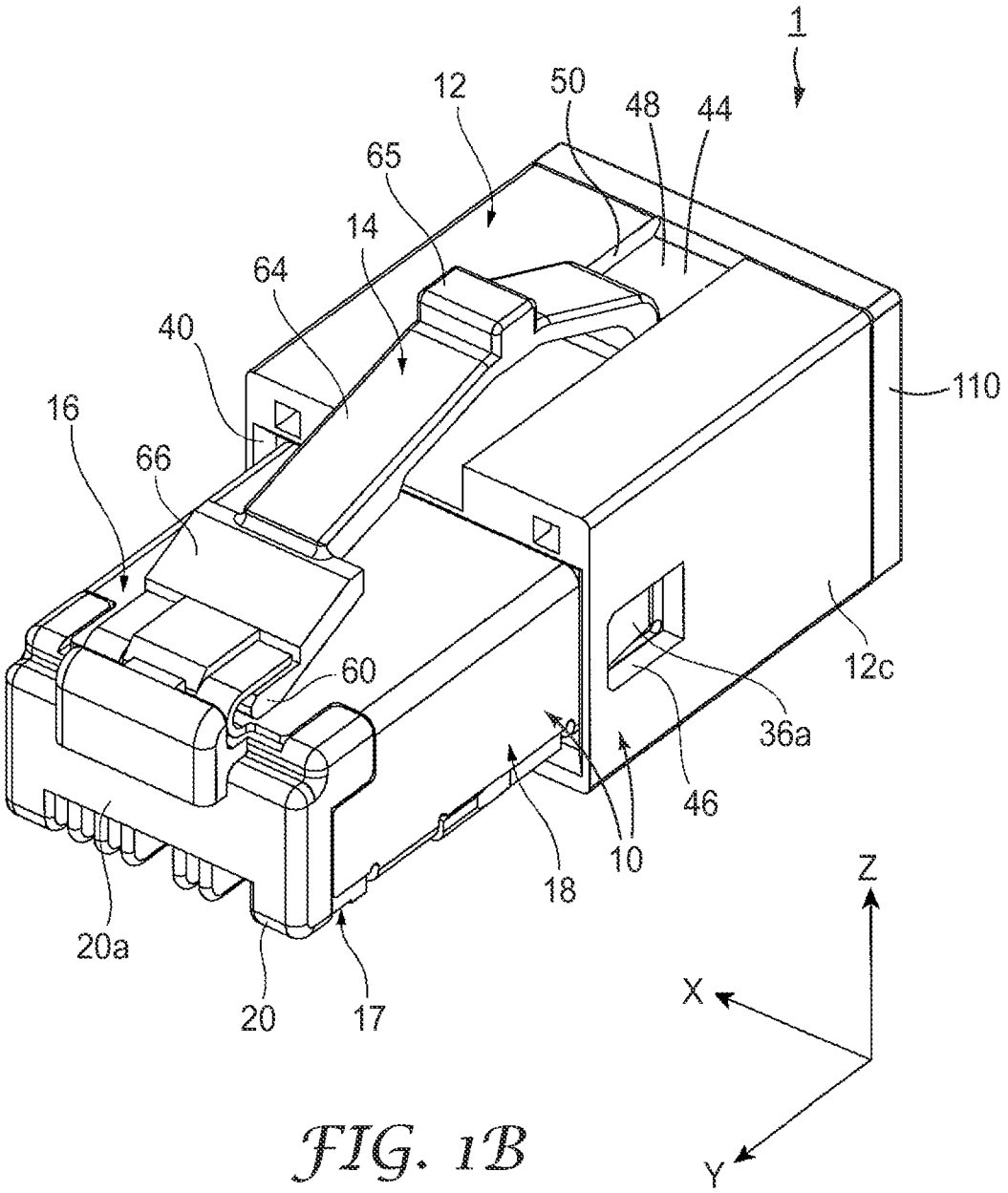
FIG. 1B is a perspective view of a connector having a second body in a second state.

In the following description, reference is made to the accompanying set of drawings that form a part of the description hereof and in which are shown by way of illustration specific embodiments. The figures are not necessarily to scale. Unless indicated otherwise, similar features for one embodiment may include the same materials, have the same attributes, and serve the same or similar functions as similar features for other embodiments. Additional or optional features described for one embodiment may also be additional or optional features for other embodiments, even if not explicitly stated, where appropriate. It is to be understood that other embodiments are contemplated and may be made without departing from the scope or spirit of the present description. The following detailed description, therefore, is not to be taken in a limiting sense.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

As used herein, layers, components, or elements may be described as being adjacent one another. Layers, components, or elements can be adjacent one another by being in direct contact, by being connected through one or more other components, or by being held next to one another or attached to one another. Layers, components, or elements that are in direct contact may be described as being immediately adjacent.

One of the causes of network downtime is connections that work loose over time due to machine vibration, for example, or connections that are accidently knocked loose. A common Ethernet connector is the RJ (Registered Jack)-45 connector. Conventional RJ-45 connectors do not provide a mechanism for preventing accidental disconnection. The present description provides connectors which have a latch that may be substantially locked when the connector is placed into a mating connector thereby preventing accidental disconnection.

In some embodiments of the present description, a connector includes a first channel, a second channel and a latching member having a portion that is slidably attached to the first channel. The second channel is configured to move relative to the first channel so that the first channel and the second channel can be aligned or misaligned. When the channels are aligned, a continuous channel is formed. In this case, the slidably attached portion of the latching member is free to move in the continuous channel and this allows the latching member to latch with and unlatch from a mating connector. When the channels are misaligned, the movement of the slidably attached portion of the latching member is restricted thereby preventing the latching member from latching with and unlatching from a mating connector. The connector may be used by placing the second channel in alignment with the first channel and inserting the connector into a mating connector causing the latching member to latch with the mating connector. The second channel may then be placed in misalignment with the first channel thereby preventing the latching member from accidently unlatching from the mating connector.

In some embodiments, the connector further includes a first body, which includes a mating end for mating with a mating connector, and a second body, which includes a rear end opposite the mating end for receiving a cable or cables. The first body includes the first channel which extends along a mating direction of the connector and the second body includes the second channel which extends along the mating direction. The second body may be adjacent to the first body and may be rotatably attached to the first body.

In some embodiments, the latching member further includes a fixed end that is fixedly attached to the first body proximate the mating end. The slidably attached portion of the latching member is a sliding end that is slidably attached to the first channel proximate the second body. An elongated latching arm joins the fixed end to the sliding end. The latching member also includes a latch portion extending from the latching arm for latching with and unlatching from a mating connector.

In some embodiments, the second body is configured to move relative to the first body between first and second states such that placing the second body in the first state aligns the second channel with the first channel and placing the second body in the second state misaligns the second channel with the first channel. For example, the second body may be configured to rotate along an axis substantially parallel to the mating direction and a first state may correspond to a zero degree rotation, while the second state may correspond to a 90 degree or a 180 degree rotation or some other non-zero rotation. When the second body is in the first state and the latching arm is pressed, the sliding end slides into the second channel allowing the latch portion to latch with and unlatch from a mating connector. When the second body is in the second state and the latching arm is pressed, the sliding end is prevented from entering the second channel because in this case the second channel is not aligned with the first channel. The latch portion is thereby prevented from latching with or unlatching from a mating connector when the first body is in the second state.

The connector may be an electrical connector, a fiber optic connector, an electro-optical connector or another type of connector that is capable of attaching a cable to a device, or one device to another device, for example. In some embodiments, the connector is an RJ-45 connector which may be in compliance with the ISO/IEC8877 standard, for example.

Figure 2:
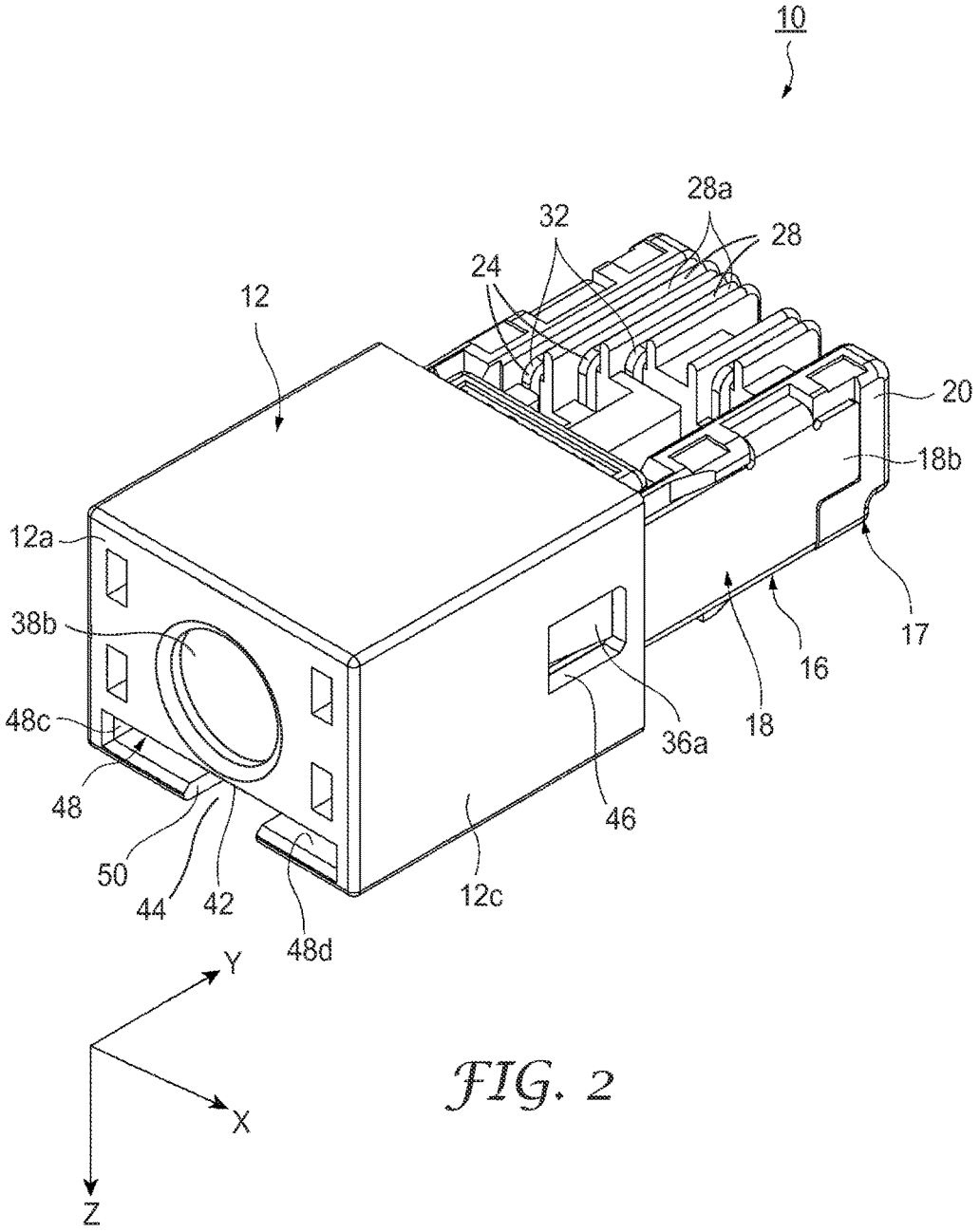
FIG. 2 is a perspective view from a lower side of a portion of the connector depicted in FIG. 1A.
Figure 3A:
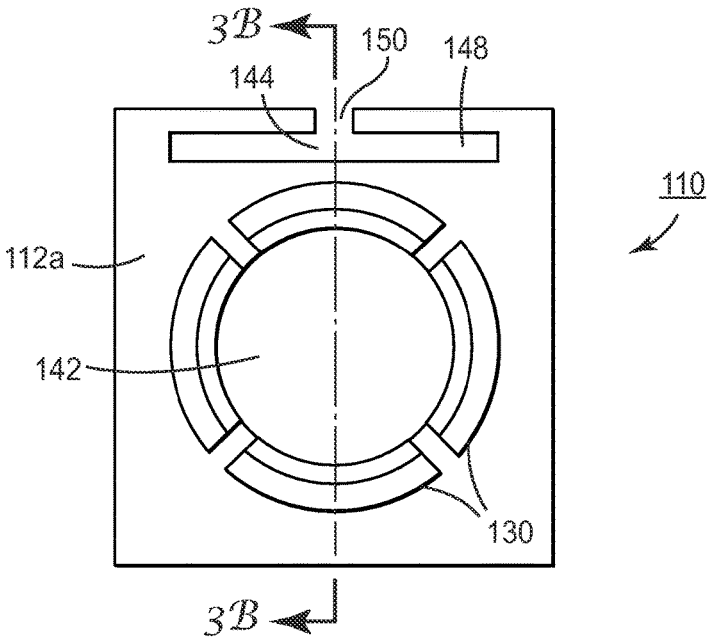
FIG. 3A is a front view of a second body of a connector.
Figure 3B:
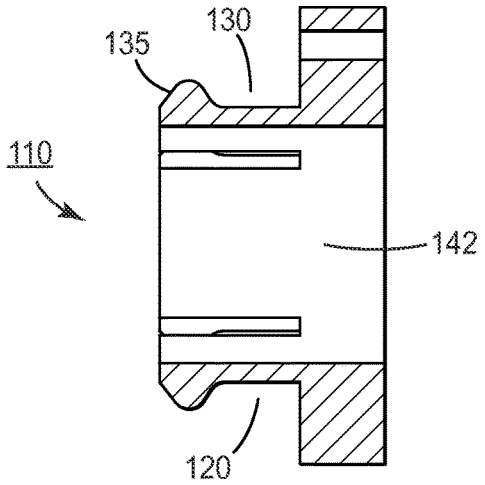
FIG. 3B is a cross-sectional view of a second body of a connector.
Figure 3C:
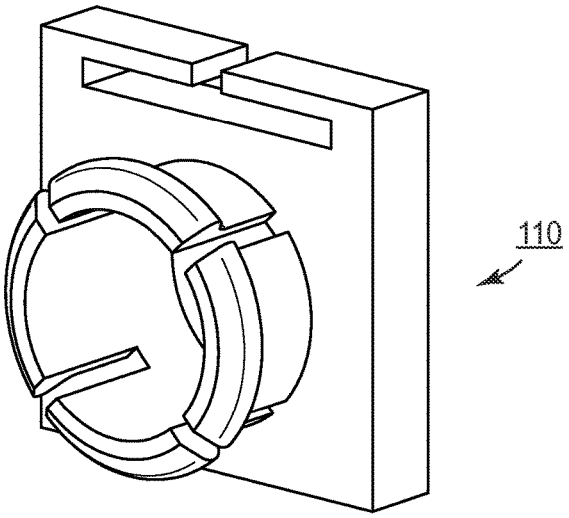
FIG. 3C is a perspective view of a second body of a connector.
Figure 4:
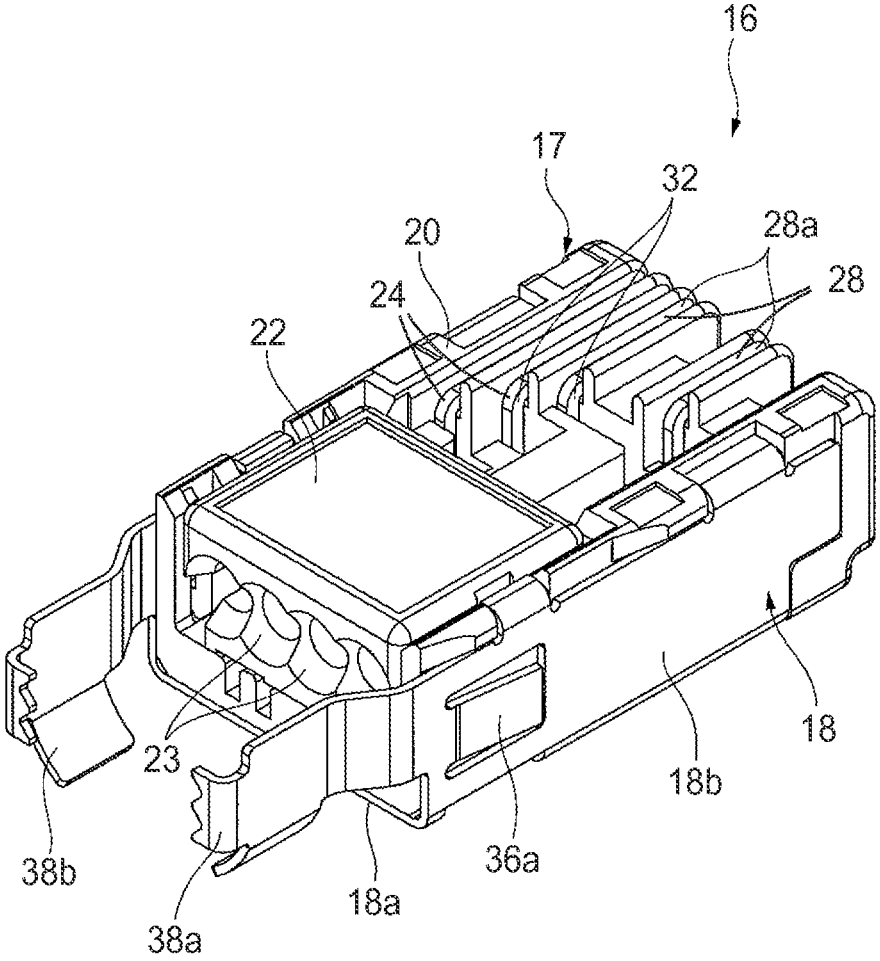
FIG. 4 is a perspective view of a portion of a connector.
Figure 5:
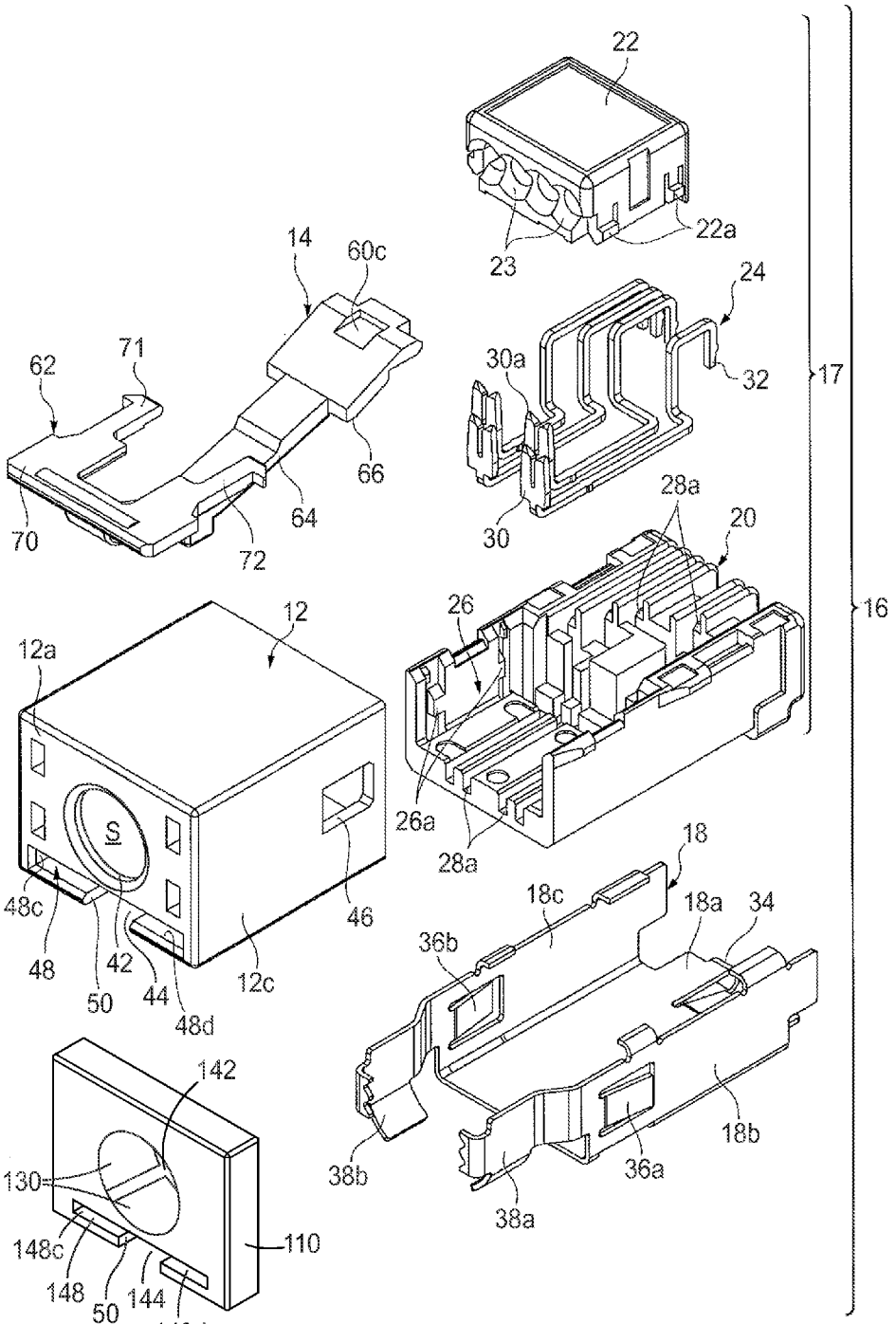
FIG. 5 is an exploded perspective view of a connector.
Figure 6:
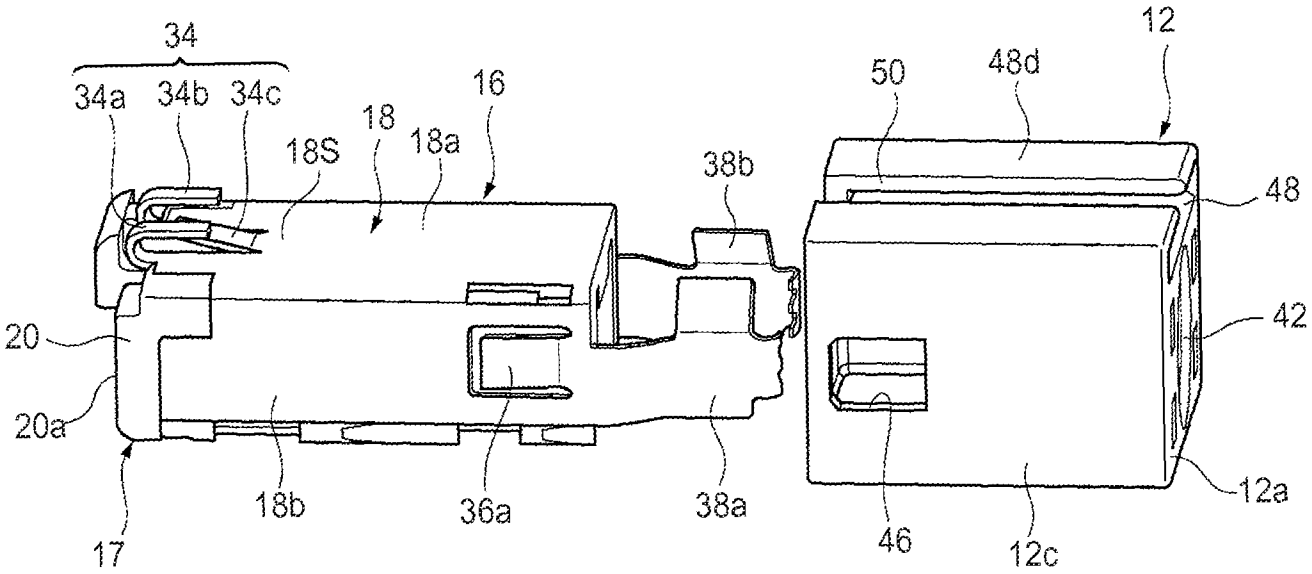
FIG. 6 is a perspective view of a mating component and a connector case.
Figure 7A:
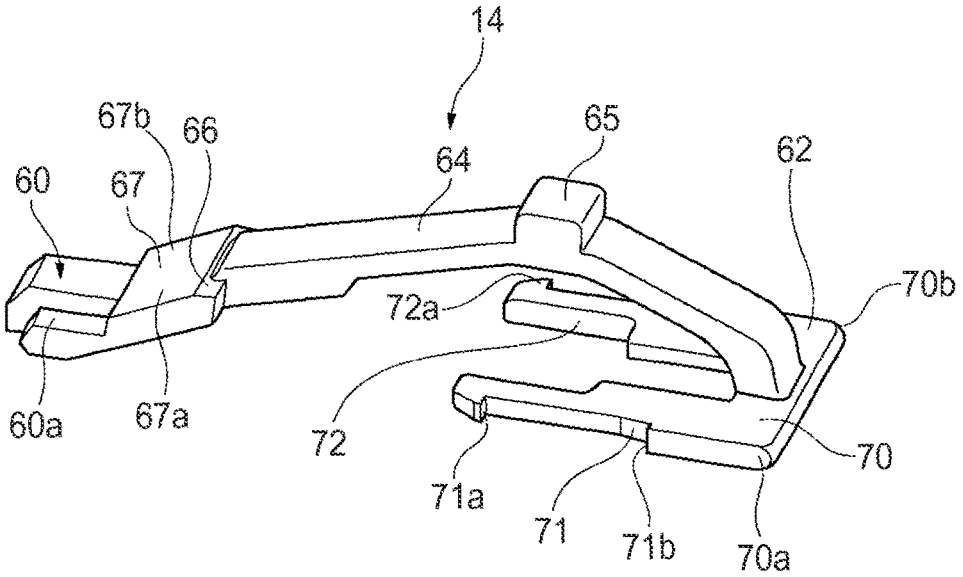
FIGS. 7A, 7B and 7C are perspective views of a latching member.
Figure 7B:
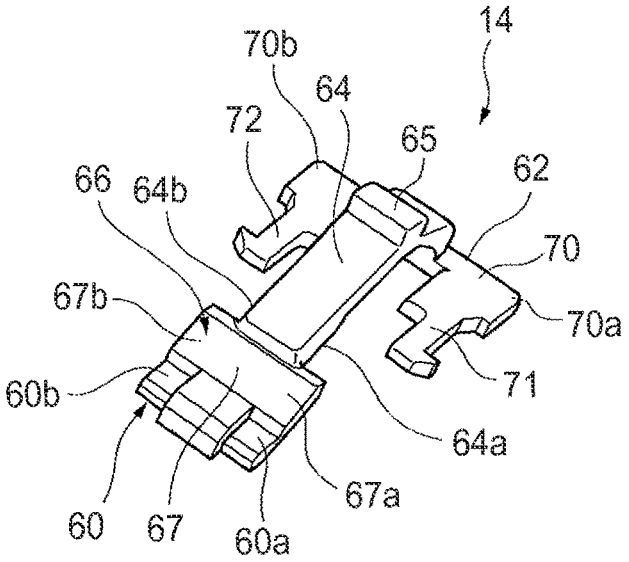
Figure 7C:
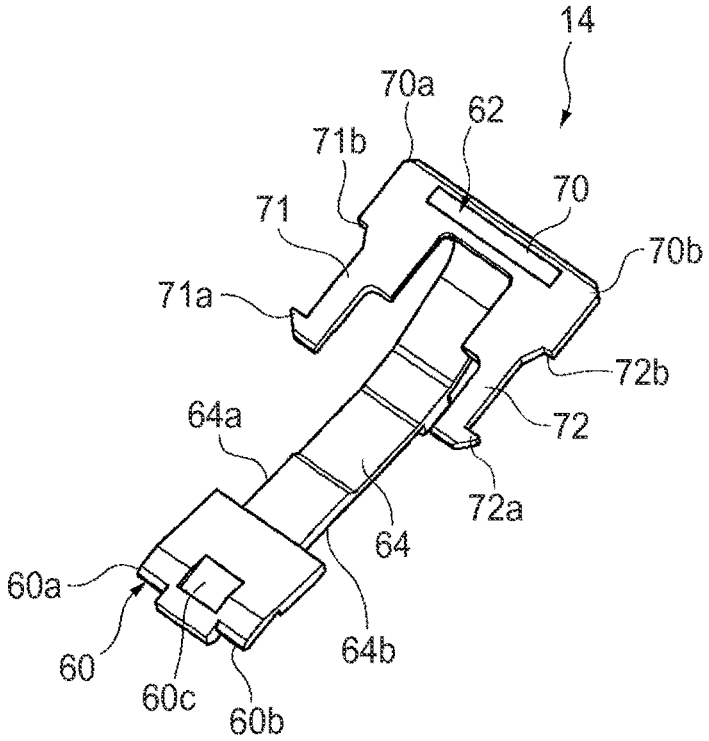
Figure 8A:
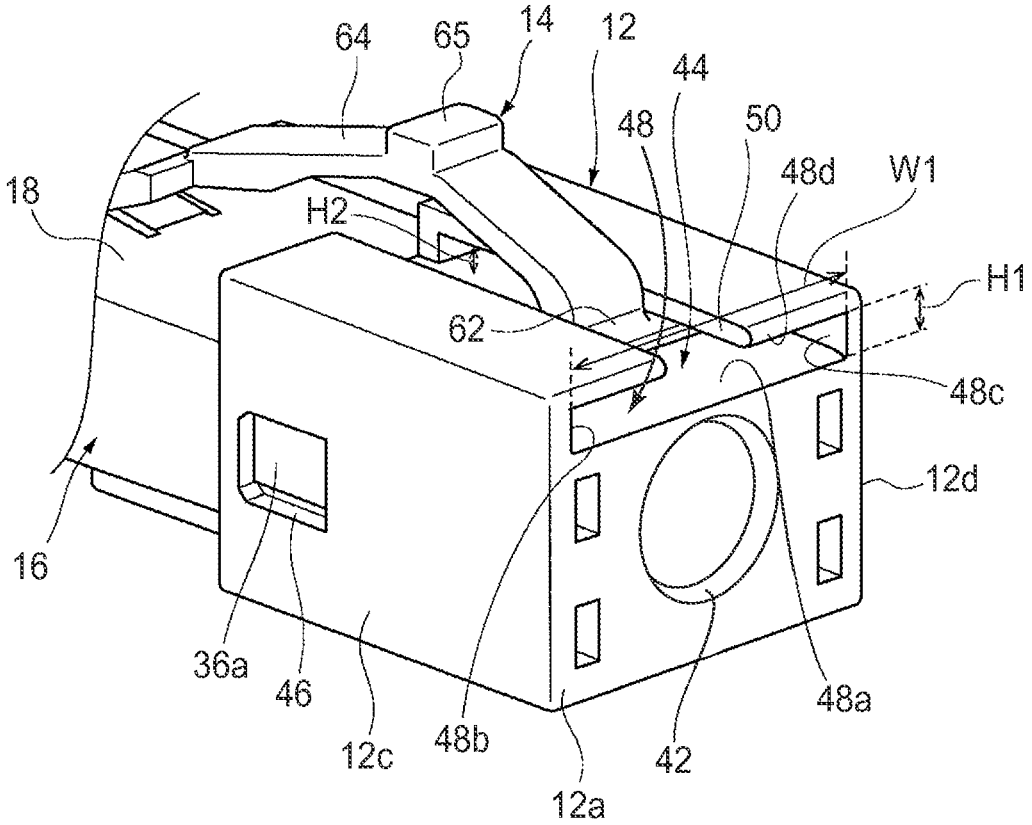
FIG. 8A is a perspective view of a portion of a connector from the rear side.
Figure 8B:
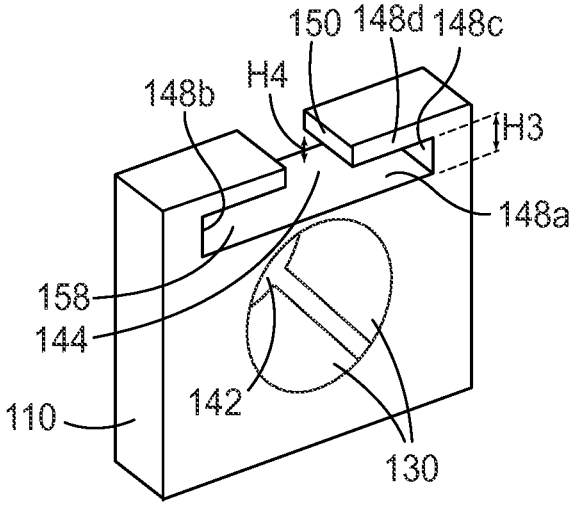
FIG. 8B is a perspective view of a second body of a connector from the rear side.
Figure 9:
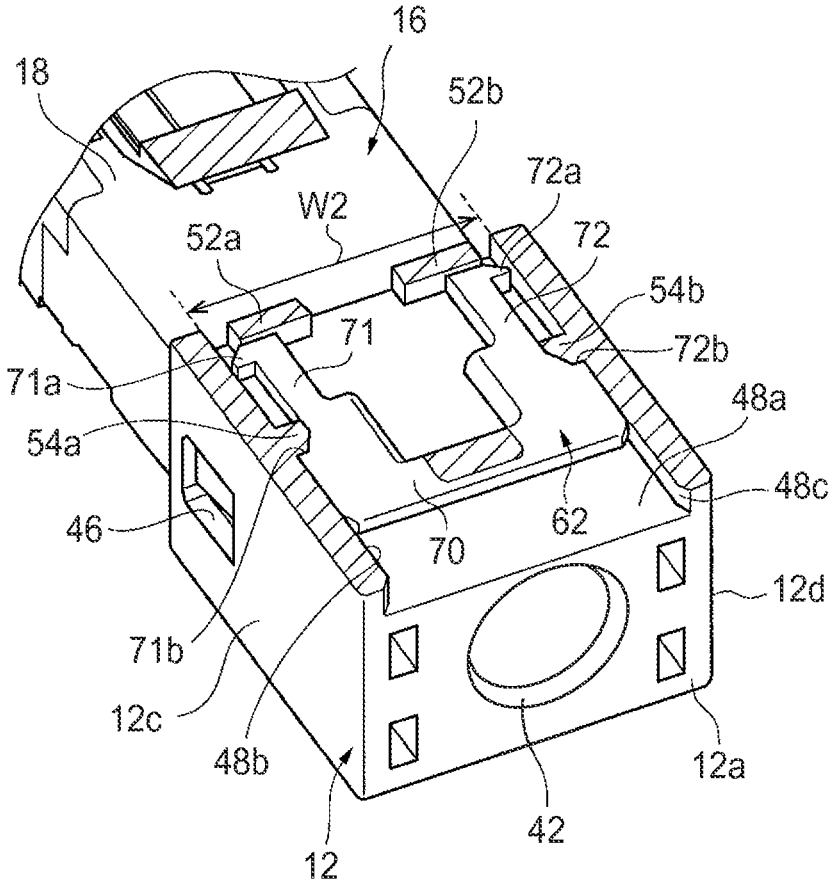
FIG. 9 is a perspective view of a partial cross-section of a first body of a connector.

An embodiment of a connector of the present description is illustrated in FIGS. 1A-9. FIG. 1A is a perspective view of connector 1. In the embodiment shown, connector 1 is an RJ-45 connector and is configured as a plug connector suitable for insertion into a mating connector. Connector 1 includes first body 10, second body 110 and latching member 14 attached to first body 10. First body 10 includes connector case 12 and mating component 16. Connector case 12 also includes first channel 44 which includes first slide groove 48 and first slit 50. Second body 110 includes second channel 144 which includes second slide groove 148 and second slit 150. In FIG. 1A, second body 110 is in a first state where first channel 44 and second channel 144 are aligned. FIG. 1B shows connector 1, with second body 110 in a second state where first channel 44 and second channel 144 are misaligned. FIG. 2 is a perspective view showing the lower side of the first body 10 of connector 1. FIG. 3A is a front view of second body 110 of connector 1, FIG. 3B is a cross-sectional view of second body 110 of connector 1, and FIG. 3C is a perspective view of second body 110 of connector 1. Second body 110 includes snap-fit protrusions 130 and cable insertion opening 142. Snap-fit protrusions 130 include ridge portions 135 and depressions 120. FIG. 4 is a perspective view of mating component 16. FIG. 5 is an exploded perspective view of connector 1. FIG. 6 is a perspective view of mating component 16 and connector case 12. FIGS. 7*a*, 7*b* and 7*c* are perspective views of latching member 14. FIG. 8A is a perspective view of a portion of first body 10 and FIG. 8B is a perspective view of second body 110. FIG. 9 is a perspective view of a partial cross-section of first body 10.

An X,Y,Z coordinate system is defined in FIGS. 1A-2. Connector 1 has a width in the X direction, a length in the Y direction and a height in the Z direction. The side of connector 1 that may be inserted into a plug insertion opening (not illustrated) of a mating connector (e.g., modular jack) is denoted as the "front" or "mating end" and the side in which a cable may be inserted is denoted as the "back" or "rear end". The "top" or "upper" side of connector refers to the side to which latching member 14 is attached and the "bottom" or "lower" side refers to the side opposite the top side. The mating direction is the Y-direction which is along a length of the connector between the mating and rear ends.

Connector 1 may be attached to a terminal of a cable (for example, cable 3 of FIG. 10) which may be a communication cable, for example a LAN (local area network) cable having four core wires (for example, core wires 5 of FIG. 10) and a shielding that covers an outer circumference of the core wires as a whole.

First body 10 is configured having a portion of mating component 16 housed in connector case 12 which includes an opening 40 into which a portion of mating component 16 is inserted. Mating component 16, which is a portion of connector 1 that may be inserted into a target mating connector, includes assembly 17 and shielding member 18 which includes protruding portions 36*a* and 36*b* that engage with engagement portions 46 of connector case 12. In the embodiment illustrated in FIGS. 1A-9, connector case 12 is a first portion of first body 10 that has a larger cross-section in the X-Z plane than mating component 16 which is a second portion of first body 10. The larger first portion (connector case 12) is removably assembled to the smaller second portion (mating component 16). The second portion includes mating end 20*a*.

Assembly 17 includes housing 20, cable cover 22, and contact members 24. Housing 20 may be formed of a plastic material which may have electrically insulating properties. Suitable materials include polybutylene terephthalate (PBT) and polyamide (PA). Housing 20 includes encasing portion 26 and contact member holding portion 28. Encasing portion 26, which is provided on a back portion of housing 20, encases and holds cable cover 22. Locking portion 26*a* is provided on encasing portion 26 for locking cable cover 22.

Housing 20 also includes mating end 20*a* which may be inserted into a mating connector.

Contact member holding portion 28 holds and fixes contact members 24. Contact member holding portion 28 has a plurality (four in the illustrated embodiment) of groove portions 28*a* where contact members 24 are disposed. Groove portions 28*a* are provided from encasing portion 26 to mating end 20*a* of housing 20. Groove portions 28*a* have shapes corresponding to the shapes of contact members 24.

Cable cover 22 may be formed from a plastic material such as PBT, PA or the like. When a cable is attached, cable cover 22 encases the core wires of the cable. Cable cover 22 has a plurality (four in the illustrated embodiment) of insertion through holes 23 though which the core wires of a cable may be inserted. Insertion through holes 23 are disposed in the back end portion of cable cover 22 and are open to the rear side. In cable cover 22, an opening (not illustrated) through which contacts 30 are inserted is provided in a position that corresponds to contacts 30 of contact members 24 when encased in encasing portion 26 of housing 20.

A locking pawl 22*a* is provided on a side wall portion of cable cover 22. Locking pawl 22*a* engages with locking portion 26*a* provided on encasing portion 26 of housing 20 thereby fixing cable cover 22 to housing 20.

The number of contact members 24 included in assembly 17 is selected according to the number of wires in the cable (or cables) that is to be attached. In the embodiment shown, four contact members 24 are provided. Each of the contact members 24 are formed from a conductive material, such as metal (e.g., copper), or the like. Each of the contact members 24 includes a contact 30 and a contact terminal 32. Contacts 30 may be disposed in encasing portion 26 in a staggered arrangement (see FIG. 10, for example). Contacts 30 have a forked shape forming slits 30*a*. Inserting (e.g., pushing) the core wires into slits 30*a* of contacts 30 electrically connects the core wires to contacts 30 since contacts 30 cut into the cover of the core wires as they are inserted.

First body 10 includes a plurality of terminals (contact terminals 32) configured to contact corresponding terminals of a mating connector. When connector 1 is inserted into a receptacle mating connector, contact terminals 32 make an electrical connection to each of the contacts of the receptacle mating connector. Contact terminals 32 are disposed in groove portions 28*a* of housing 20 and are exposed to the front end (i.e., mating end 20*a*) of housing 20.

In some embodiments, shielding member 18 is constructed from a material having elastic or spring-like characteristics. Suitable materials include metals (e.g., aluminum or copper). Shielding member 18 partially encloses assembly 17 and provides an electrically conductive path between the receptacle mating connector and the shielding of an attached cable while also functioning as an electrostatic shield. Shielding member 18 includes base portion 18*a* and a pair of side wall portions 18*b* and 18*c* which are approximately perpendicular to base portion 18*a* and located on opposite sides of base portion 18*a*. A cross-section of shielding member 18 has an approximate U shape. Shielding member 18 also includes fixed element 34, protruding portions 36*a* and 36*b*, and crimping portions 38*a* and 38*b*.

Fixed element 34 secures fixed end 60 (described elsewhere) of latching member 14. Fixed element 34, which is disposed on the front end side of shielding member 18, has two fixed pieces, 34*a* and 34*b*, and a protruding piece 34*c*. The two fixed pieces 34*a* and 34*b* are disposed with a predetermined separation in the X direction and may be attached to or formed integrally with base portion 18*a* of shielding member 18. Fixed pieces 34*a* and 34*b* have a cross-section in the Y-Z plane that appears as an approximate U shape and are folded back so as to open to the rear side (connector case 12 side).

Protruding piece 34*c* is disposed between the two fixed pieces 34*a* and 34*b*. Protruding piece 34*c* protrudes slightly upward toward the front side from a surface 18S of base portion 18*a*. Protruding piece 34*c* engages with an indented portion 60*c* (described elsewhere) of latching member 14. Fixed element 34 lifts the fixed end 60 of the latching member 14 by the protruding piece 34*c* to hold fixed end 60 by the two fixed pieces 34*a* and 34*b* which secures fixed end 60 of latching member 14 by the cooperation of the fixed pieces 34*a* and 34*b* and the protruding piece 34*c*.

Protruding portions 36*a* and 36*b* are disposed on the side wall portions 18*b* and 18*c*, respectively, toward the rear side of the shielding member 18. Protruding portions 36*a* and 36*b* are plate-like members having a substantially rectangular shape. The back side (side facing connector case 12) of protruding portions 36*a* and 36*b* are approximately flush with side wall portions 18*b* and 18*c* and the side facing mating end 20*a* protrude in the X direction so as to extend outward from the outer surface of the side wall portions 18*b* and 18*c*. Protruding portions 36*a* and 36*b* elastically deform when pressure is applied so that protruding portions 36*a* and 36*b* are pushed into the side wall portions 18*b* and 18*c*. When pressure is removed, protruding portions 36*a* and 36*b* then return to their original position.

Crimping portions 38*a* and 38*b* hold and fix a cable to first body 10 by crimping and fixing the cable thereby electrically connecting shielding member 18 to the shielding of the cable. The crimping portions 38*a* and 38*b* extend rearward from the side wall portions 18*b* and 18*c* and are mutually opposed.

In some embodiments, connector case 12 is formed of a plastic material having electrically insulating properties. Suitable materials include PBT, PA and the like. Using an electrically insulating material allows connector case 12 to be operated without interacting with any electrical charge that may be generated in shielding member 18 of assembly 17.

Connector case 12 has a hollow substantially rectangular parallelepiped shape and includes an encasing space S to encase mating component 16. Connector case 12 also includes an opening 40, snap-fit portion 42, first channel 44, and engagement portions 46. Back end portion 12*a* of connector case 12 faces front end portion 112*a* of second body 110. In the embodiment illustrated in FIGS. 1A-9, first channel 44 extends along the entire length of a first portion (connector case 12) of first body 10. In some embodiments, first channel 44 extends along only a portion of the length of first body 10 and in other embodiments, first channel 44 extends along an entire length of first body 10. In the illustrated embodiment, when second body 110 is in the first state (shown in FIG. 1A), second body 110 and a first portion (connector case 12) of first body 10 have lateral cross-sections (i.e., cross-sections in the X-Z plane) having substantially the same size and shape.

Opening 40 in connector case 12 allows a portion of mating component 16 to be inserted into connector case 12. Opening 40 has a shape substantially corresponding to the external shape of mating component 16. In the embodiment shown, opening 40 has a substantially rectangular shape.

Snap-fit portion 42 accepts snap-fit protrusions 130 of second body 110 and provides an opening through which a cable or cables may be inserted. Snap-fit portion 42 is provided on the back end portion 12*a* of the connector case 12. In the illustrated embodiment, snap-fit portion 42 has a substantially circular shape.

Second body 110 includes cable insertion opening 142, through which a cable or cables may be inserted, and snap-fit protrusions 130 which include ridge portions 135 and depressions 120. Second body 110 may be rotatably attached to first body 10 by inserting snap-fit protrusions 130 into the opening provided by snap-fit portion 42. In the illustrated embodiment, gaps are provided between separate snap-fit protrusions 130 so that snap-fit protrusions 130 can deform enough to allow assembly with snap-fit portion 42. When assembled, snap-fit portion 42 is positioned in depressions 120 and ridge portions 135 prevents second body 110 from separating from first body 10. The geometry may be chosen to provide friction between second body 110 and first body 10 so that some force is required to rotate second body 110 from a first state to a second state. This could be useful to prevent second body 110 from unintentionally shifting from a first state to a second state or vice versa.

Although in the embodiment illustrated in FIGS. 1A-9, second body 110 includes snap-fit protrusions 130 and first body 10 includes an opening for accepting snap-fit protrusions 130, in other embodiments first body 10 includes snap-fit protrusions while second body 110 includes an opening for accepting the snap-fit protrusions. The geometry of the snap-fit protrusions and snap-fit openings may also differ from the illustrated embodiment. For example, it is possible that the snap-fit opening is a ring-shaped slit (e.g., an annulus centered on a cable-insertion opening) rather than a circular opening. In this case, the snap-fit protrusions may have a tapered shape that produces a desired level of friction between first body 10 and second body 110 when inserted into the snap-fit opening. In another embodiment, a retaining ring is used to provide a rotatable connection between first body 10 and second body 110. Retaining rings are known in the art and are available from W. W. Grainger, Inc., Lake Forest, Ill., for example. In this case, a slit can be made in snap-fit portion 42 for accepting a retaining ring and a groove can be provided on a protrusion on second body 110 that accepts the retaining ring. Alternatively, first body 10 may have a snap-fit protrusion with a groove for accepting a retaining ring located in a cavity provided in second body 110. In still other embodiments, other types of rotatable connections between first body 10 and second body 110 are used. Suitable attachments methods include push-pull connector designs as described, for example, in U.S. Pat. No. 3,470,524 (Culver). The push-pull attachment can be designed so that second body 110 must be pulled away from first body 10 before it can be rotated and the first and second states.

In the embodiment illustrated in FIGS. 1A-9, second body 110 can rotate to an arbitrary degree. In other embodiments, stops are provided on back end portion 12*a* of connector case 12 and front end portion 112*a* of second body 110 so that second body 110 can only rotate from about zero degrees (corresponding to a first state) to about 90 degrees or about 180 degrees (corresponding to a second state).

Engagement portions 46 engage with the protruding portions 36*a* and 36*b* provided on the shielding member 18 of first body 10. Engagement portions 46, which are provided on side wall portions 12*c* and 12*d*, respectively, towards the front end side of connector case 12, are openings that pass through side wall portions 12*c* and 12*d*. Engagement portions 46 abut and engage with the tip end portions of the protruding portions 36*a* and 36*b* when first body 10 is inserted into connector case 12. First body 10 and connector case 12 are removably attached by engagement portions 46 and protruding portions 36*a* and 36*b*. First body 10 can be removed from connector case 12 by pressing protruding portions 36*a* and 36*b*.

In the embodiment shown in FIGS. 1A-9, the protruding portions 36*a* and 36*b* are provided on the shielding member 18 of mating component 16 and engagement portions 46 are provided on connector case 12. In other embodiments, the openings (engagement portions) may be provided on shielding member 18 and the protruding portions may be provided on connector case 12.

First channel 44 includes first slide groove 48 and first slit 50. Sliding end 62 of latching member 14 is positioned in first slide groove 48. First slide groove 48 is disposed above snap-fit portion 42 of the connector case 12 and open to back end portion 12*a*. First slide groove 48 has a bottom portion 48*a*, side portions 48*b* and 48*c*, and a top portion 48*d*. A cross-section of first slide groove 48 in the X-Z plane has a substantially rectangular shape. Similarly, second channel 144 includes second slide groove 148 and second slit 150. Second slide groove 148 is disposed above cable insertion opening 142 of second body 110 and is open to front end portion 112*a*. Second slide groove 148 has a bottom portion 148*a*, side portions 148*b* and 148*c*, and a top portion 148*d*. A cross-section of second slide groove 148 in the X-Z plane when second body 110 is in the first state (see FIG. 1A) has a substantially rectangular shape. Latching member 14 can move in first channel 44 when second body 110 is the first state. However, latching member 14 is restrained from moving in first channel 44 when second body 110 is in the second state (see FIG. 1B).

Bottom portion 48*a* is above snap-fit portion 42 and is a flat portion that extends from the front end portion to the back end portion of connector case 12. Top portion 48*d* constitutes the upper side portion of connector case 12 and opposes bottom portion 48*a*. The pair of side portions 48*b* and 48*c* extend in the Z direction from opposite sides of bottom portion 48*a* and link the bottom portion 48*a* and the top portion 48*d*.

First slide groove 48 has a first height H1 between bottom portion 48*a* and top portion 48*d* on the back end side of connector case 12, a second height H2 between bottom portion 48*a* and top portion 48*d* on the front end side of the connector case 12, a first width W1 between the pair of side portions 48*b* and 48*c* on the back end side of connector case 12, and a second width W2 between the pair of side portions 48*b* and 48*c* on the front end side of connector case 12. In some embodiments, the first and second heights are approximately equal (i.e., H1≈H2) and the first and second widths are approximately equal (i.e., W1≈W2) so that first slide groove 48 is a substantially constant space from the front end to the back end of the connector case 12. The first and second heights H1 and H2 between bottom portion 48*a* and top portion 48*d* may be approximately equal to or slightly greater than the thickness of the sliding end 62 of the latching member 14. The first and second widths W1 and W2 between the pair of side portions 48*b* and 48*c* may be approximately equal to or slightly greater than the width (dimension in the X direction) of sliding end 62 of latching member 14. A suitable selection of the first and second heights, H1 and H2, and the first and second widths, W1 and W2, allow the movement of the sliding end 62 of the latching member 14 in first slide groove 48 to be restrained in the X direction (width direction) and in the Z direction (height direction) while allowing substantially free movement in the mating direction (Y direction) over a range when second body 110 is in a first state so that second channel 144 is substantially aligned with first channel 44.

Second slide groove 148 has a third height H3 between bottom portion 148*a* and top portion 148*d* on the back end side of second body 110, a fourth height H4 between bottom portion 148*a* and top portion 148*d* on the front end side of second body 110, a third width W3 between the pair of side portions 148*b* and 148*c* on the back end side of second body 110, and a fourth width W4 between the pair of side portions 148*b* and 148*c* on the front end side of second body 110. In some embodiments, the third and fourth heights are approximately equal (i.e., H3≈H4) and the third and fourth widths are approximately equal (i.e., W3≈W4) so that second slide groove 148 is a substantially constant space from the front end to the back end of second body 110. The second and third heights H3 and H4 between bottom portion 148*a* and top portion 148*d* may be approximately equal to or slightly greater than the thickness of sliding end 62 of latching member 14. The third and fourth widths W3 and W4 between the pair of side portions 148*b* and 148*c* may be approximately equal to or slightly greater than the width (dimension in the X direction) of sliding end 62 of latching member 14.

A suitable selection of the third and fourth heights, H3 and H4, and the third and fourth widths, W3 and W4, allow the movement of the sliding end 62 to extend into second channel 144 when second body 110 is in a first state where second channel 144 is substantially aligned with first channel 44. When second body 110 is in a second state where second channel 144 is misaligned with first channel 44, then sliding end 62 of latching member 14 cannot extend into second channel 144. When pressing portion 65 is pressed while second body 110 is in the second state, the movement of latching member 14 is thereby sufficiently restricted that that latch portion 66 is prevented from latching with or unlatching from a mating connector.

In the embodiment illustrated in FIGS. 1A-9, first channel 44 and second channel 144 have lateral cross-sections (i.e., cross sections in the X-Z plane) having substantially the same size and shape and have geometries that satisfy the relationships H1≈H2≈H3≈H4 and W1≈W2≈W3≈W4. When second body 110 is in a first state where first channel 44 and second channel 144 align, first channel 44 and second channel 144 form a substantially continuous channel. Second channel 144 has a lateral cross-section (i.e., cross-section in the X-Z plane) that is substantially the same as the lateral cross-section of first channel 44. When second body 110 is in a first state where first channel 44 and second channel 144 align, first channel 44 and second channel 144 form a substantially continuous and uniform channel.

Configuring first channel 44 and second channel 144 to have a substantially constant space in the Y direction allows the sliding end 62 to slide smoothly. Further, this type of configuration may be preferred from the perspective of manufacturing connector 1. Alternate geometries of the first and/or second channels may also be used. For example, the first and/or second slide groove may have a shape that tapers toward the front. In this case, the shape of the sliding end 62 may also be shaped to taper toward the fixed end 60.

In the embodiment illustrated in FIGS. 1A-9, second channel 144 extends through the length (dimension in the Y-direction) of second body 110. In other embodiments, second channel 144 may extend only partway through the length of second body 110 and still allow enough movement of sliding end 62 when second channel 144 is aligned with first channel 44 so that latch portion 66 can latch with or unlatch from a mating connector.

First channel 44 also regulates movement in the mating direction (Y-direction) by providing stops which prevent latching member 14 from moving too far forward or backward in the Y-direction. First slide groove 48 includes first regulating portions 52*a* and 52*b* and second regulating portions 54*a* and 54*b* which regulate sliding in the mating direction of sliding end 62 of latching member 14. First regulating portions 52*a* and 52*b* are disposed on the front end of first channel 44 at a predetermined distance in the X direction and connect bottom portion 48*a* and top portion 48*d*. First regulating portions 52*a* and 52*b* regulate the movement of the sliding end 62 in the forward direction by acting as stops preventing further forward movement.

Second regulating portions 54*a* and 54*b* are disposed further to the center portion in the Y direction of first slide groove 48 and are projections protruding from the pair of side portions 48*b* and 48*c*. Second regulating portions 54*a* and 54*b* regulate the movement of the sliding end 62 in the rearward direction. Sliding end 62 is disposed between first regulating portions 52*a* and 52*b* and second regulating portions 54*a* and 54*b* so that it can slide substantially freely. The distance between first regulating portions 52*a* and 52*b* and second regulating portions 54*a* and 54*b*, which is the maximum sliding distance of the sliding end 62 when second channel 144 is aligned with first channel 44, may be, for example, less than 5 mm when the length in the Y direction of first body 10 is approximately from 20 to 40 mm. In some embodiments, the distance between the first regulating portions 52*a* and 52*b* and the second regulating portions 54*a* and 54*b* is approximately from 2 to 3 mm.

First slit 50 provides a passage that arm portion 64 of latching member 14 is allowed to pass through. In the embodiment illustrated in FIGS. 1A-9, first slit 50 is disposed in top portion 48*d* of connector case 12 and forms a continuous open space with first slide groove 48. First slit 50 extends in a belt-like shape in the Y direction at substantially the center in the X direction of the top portion 48*d*. In the illustrated embodiment, first slit 50 is formed from the front end to the back end of connector case 12. The width of first slit 50 may be equal to or slightly greater than the width of the arm portion 64 of the latching member 14 thereby regulating the movement in the X direction of the arm portion 64. Similarly, second slit 150 provides a passage for arm portion 64 of latching member 14 when second channel 144 is aligned with first channel 44.

Latching member 14 includes fixed end 60, sliding end 62, arm portion 64, and latch portion 66. Fixed end 60 is attached to fixed element 34 of shielding member 18. Latch portion 66 is adjacent fixed end 60 and arm portion 64 is adjacent latch portion 66 opposite fixed end 60. Sliding end 62 is adjacent arm portion 64 opposite latch portion 66.

Fixed end 60 is fixed to shielding member 18 of mating component 16. Fixed end 60 has two side portions 60*a* and 60*b* that are inserted into and clamped by fixed pieces 34*a* and 34*b* of fixed element 34 of shielding member 18, and indented portion 60*c* that is locked with protruding piece 34*c*. Side portions 60*a* and 60*b* are disposed with a prescribed spacing in the X direction (width). Indented portion 60*c* is positioned between side portion 60*a* and side portion 60*b* in the X direction and has a substantially rectangular shape. Fixed end 60 can be attached to and detached from the fixed element 34 of first body 10.

Sliding end 62 is slidably attached to first channel 44 of connector case 12. Sliding end 62 can be attached to and detached from first channel 44. Sliding end 62 has an approximate U shape and includes a base portion 70 and first and second extension portions 71 and 72. Base portion 70 forms a plate-like shape that extends in the X direction and is linked to a first end portion (the end portion on the opposite side of the fixed end 60) of the arm portion 64. The arm portion 64 is linked at substantially the center portion of base portion 70. The first and second extension portions 71 and 72 are provided on both end portions 70*a* and 70*b*, respectively, of base portion 70.

First extension portion 71 is a plate-like member that extends from end portion 70*a* of base portion 70 to fixed end 60. First extension portion 71 has a locking pawl 71*a* and an abutting portion 71*b*. Locking pawl 71*a* is provided on the tip end portion of first extension portion 71 and projects outward in the X direction. The tip end portion of first extension portion 71 is substantially L shaped due to locking pawl 71*a*. Abutting portion 71*b* is provided on the base end portion side of the first extension portion 71 oppose locking pawl 71*a* at a predetermined distance.

Similarly, second extension portion 72 extends from end portion 70*b* of base portion 70 to fixed end 60. First extension portion 71 and second extension portion 72 extend from base portion 70 substantially in parallel. Second extension portion 72 has a locking pawl 72*a* and an abutting portion 72*b*. Locking pawl 72*a* is provided on the tip end portion of second extension portion 72 and projects outward in the X direction. The tip end portion of second extension portion 72 is substantially L shaped due to locking pawl 72*a*. Abutting portion 72*b* is provided on the base end portion side of the second extension portion 72 oppose locking pawl 72*a* at a predetermined distance.

As illustrated in FIG. 9, when first and second extension portions 71 and 72 slide to the front end side in first channel 44, the tip end portions abut first regulating portions 52*a* and 52*b* and the abutting portions 71*b* and 72*b* are locked into second regulating portions 54*a* and 54*b*. The movement of sliding end 62 is thus regulated in the forward Y direction by first regulating portions 52*a* and 52*b*, second regulating portions 54*a* and 54*b*, and first and second extension portions 71 and 72. When second body 110 is in the first state and first and second extension portions 71 and 72 slide to the back end side in first channel 44, locking pawls 71*a* and 72*a* lock in second regulating portions 54*a* and 54*b*. The movement of sliding end 62 is thus regulated in the backward Y direction by second regulating portions 54*a* and 54*b* and locking pawls 71*a* and 72*a*.

Arm portion 64 links fixed end 60 and sliding end 62. Arm portion 64 may be an elongated member as shown in the illustrated embodiment and may have a degree of flexibility and elasticity. Arm portion 64 has an approximately downward facing U-shape when viewed from the X direction. In the embodiment shown, pressing portion 65 is provided on arm portion 64. When using connector 1, a user may press down on pressing portion 65 in order to operate latching member 14.

Latch portion 66 is configured to engage with a mating connector. Latch portion 66 has a flat surface 67 in a substantially rectangular shape. Flat surface 67 extends in the X (width) direction and includes first portion 67*a*, which extends further outward in the X direction than first side portion 64*a* of arm portion 64, and second portion 67*b*, which extends further outward in the X direction than second side portion 64*b* of arm portion 64.

When removing connector 1 from a mating connector, pressing portion 65 provided on the arm portion 64 of the latching member 14 is pressed toward connector case 12. If second channel 144 is aligned with first channel 44, this pressing action slides sliding end 62 along first slide groove 48 while also moving arm portion 64 along first slit 50. Sliding end 62 is allowed to slide into second channel 144 when second body 110 is in the first state. This movement causes latch portion 66 to lower toward connector case 12 and thereby releases the engagement between the mating connector and latch portion 66. After the engagement between latch portion 66 and the receptacle connector is released, releasing the pressure applied to latching member 14 allows the sliding end 62 to slide to the front side (direction approaching the fixed end 60) and return to the initial position (position depicted in FIG. 9) due to the elasticity of arm portion 64 of latching member 14.

If second body 110 is in a state where second channel 144 is misaligned with first channel 44, sliding end 62 is substantially prevented from sliding into second channel 144 preventing latch portion 66 from lowering toward connector case 12 and thereby preventing the release of the engagement between the mating connector and latch portion 66 when a force is applied to pressing portion 65.

Figure 10:
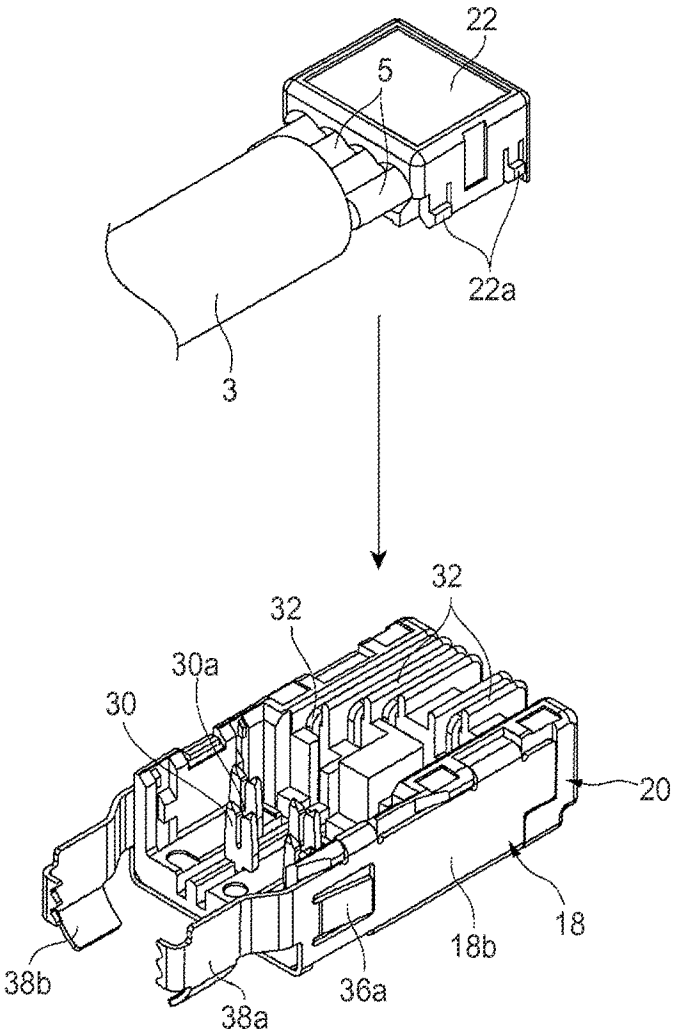
FIG. 10 illustrates procedures for assembling a connector.
Figure 10:
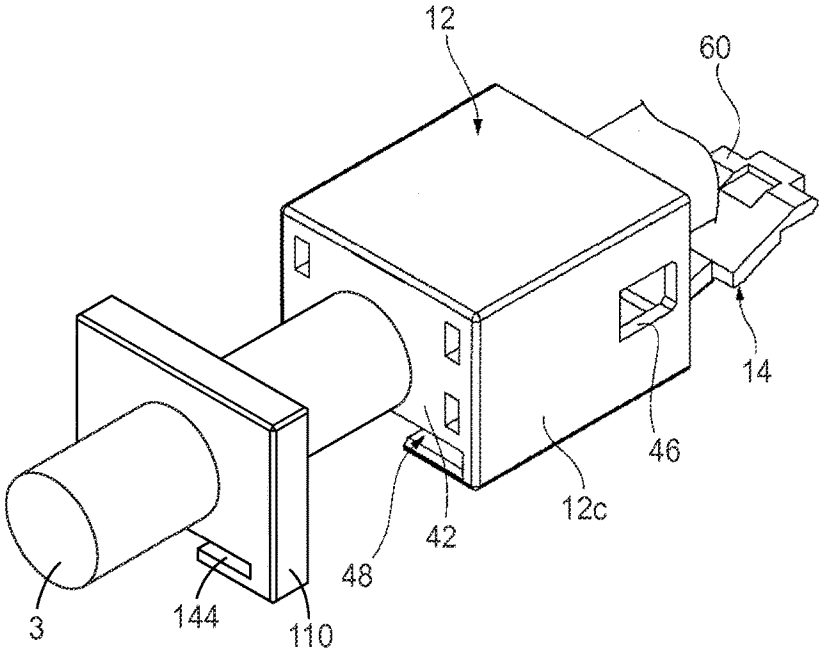

A method of assembling connector 1 is illustrated in FIG. 10 and FIG. 11. As illustrated in FIG. 10, the terminal of cable 3 is first inserted into cable insertion opening 142 of second body 110 and then inserted into the opening provided by snap-fit portion 42 of connector case 12. Sliding end 62 of latching member 14 is attached to first channel 44 of connector case 12 and second body 110 is attached to first body 10 by inserting snap-fit protrusions 130 into the opening provided by snap-fit portion 42. Core wires 5 of cable 3 are then inserted into respective insertion through holes 23 of cable cover 22.

Figure 11B:
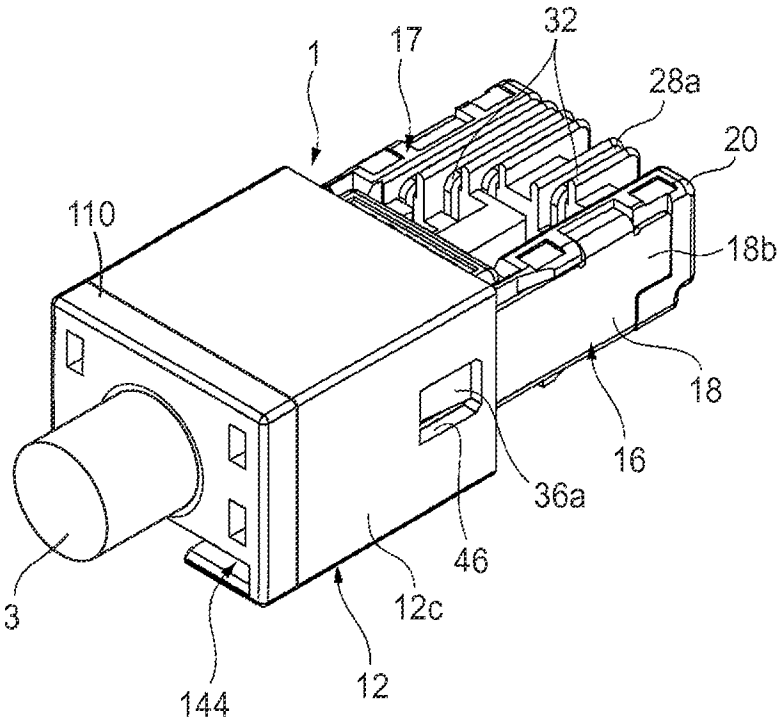
FIGS. 11A and 11B illustrate procedures for assembling a connector.
Figure 11A:
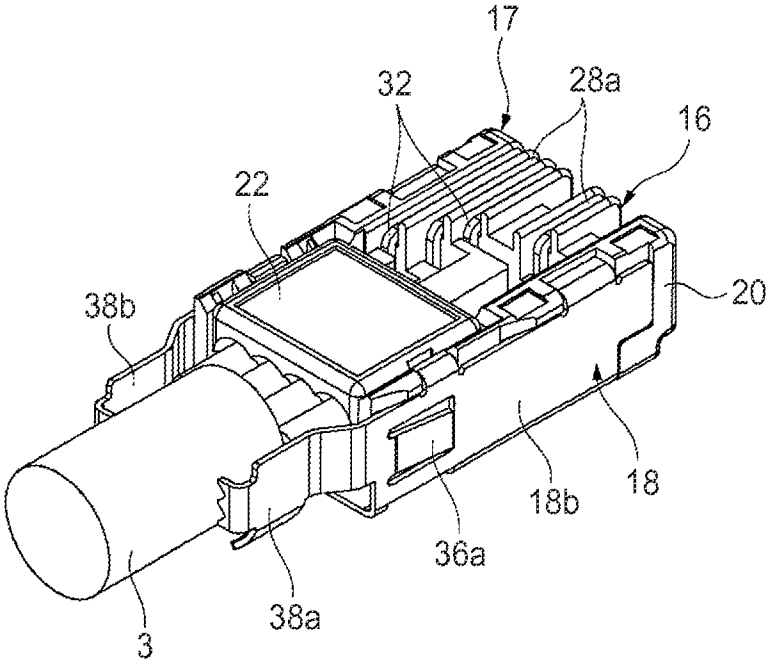

Next, as illustrated in FIG. 11A, cable cover 22 is encased in encasing portion 26 of housing 20 with core wires 5 of cable 3 held by cable cover 22. When cable cover 22 is pushed into housing 20, core wires 5 are pushed into contacts 30 of contact members 24 and the lead wires of core wires 5 are thereby electrically connected to contacts 30. Subsequently, the crimping portions 38*a* and 38*b* of shielding member 18 are crimped to fix cable 3 to shielding member 18.

Next, as illustrated in FIG. 11B, connector case 12 and second body 110 are moved along cable 3 and connector case 12 is attached to shielding member 18. Finally, as shown in FIG. 1A, fixed end 60 of the latching member 14 is fixed to the fixed element 34 of shielding member 18.

In the embodiment shown in FIGS. 10-11, a single cable 3 is attached to connector 1. In other embodiments, a plurality of cables may be attached to connector 1. In this case, cable insertion opening 142 and snap-fit portion 42 may be formed according to the desired number of cables. For example, the diameter of the opening provided by snap-fit portion 42 may be selected so that a desired number of cables fit through the opening.

In addition to preventing accidental disconnection, the connectors of the present description also provide a reduced risk of failure compared to conventional connectors. In the embodiment illustrated in FIGS. 1A-9, fixed end 60 is fixedly attached to first body 10 and sliding end 62 is slidably attached to first channel 44. Therefore neither end portion of latching member 14 is free and as a result, the likelihood of failure of arm portion 64 due to catching on other articles or the like is low. The configuration where latching member 14 does not have a free end is also effective in reducing the size of connector 1 compared to conventional designs.

In the embodiment illustrated in FIGS. 1A-9, first regulating portions 52*a* and 52*b* and second regulating portions 54*a* and 54*b* are provided in first slide groove 48 thereby regulating the movement of the sliding end 62 in the mating (Y) direction. Therefore, the application of a large load to arm portion 64 will not cause sliding end 62 to move excessively, thereby reducing the likelihood of failure of latching member 14.

The following is a list of embodiments of the present description:

Item 1 is a connector comprising:

a first body including:

a mating end of the connector for mating with a mating connector; and a first channel extending along a mating direction of the connector;

a second body including:

a rear end of the connector opposite the mating end for receiving an cable; and a second channel extending along the mating direction; and a latching member disposed along the mating direction and including:

a fixed end fixedly attached to the connector body proximate the mating end;

a sliding end slidably attached to the first channel proximate the rear end;

an elongated latching arm joining the fixed end to the sliding end; and a latch portion extending from the latching arm for latching with and unlatching from a mating connector, the second body configured to move relative to the first body between first and second states, the second body in the first state aligns the second channel with the first channel so that when the latching arm is pressed the sliding end slides into the second channel allowing the latch portion to latch with and unlatch from a mating connector, the second body in the second state misaligns the second channel with the first channel so that when the latching arm is pressed the sliding end is prevented from sliding into the second channel preventing the latch portion from latching with and unlatching from a mating connector.

Item 2 is the connector of item 1, wherein the mating direction is along a length of the connector between the mating and rear ends.

Item 3 is the connector of item 1, wherein the first channel extends along only a portion of a length of the first body.

Item 4 is the connector of item 1, wherein the first channel extends along an entire length of the first body.

Item 5 is the connector of item 1, wherein the first body includes a larger first portion removably assembled to a smaller second portion, the second portion including the mating end.

Item 6 is the connector of item 5, wherein the first channel extends along an entire length of the first portion.

Item 7 is the connector of item 5, wherein when the second body is in the first state, the second body and the first portion have lateral cross-sections having substantially the same size and shape.

Item 8 is the connector of item 1, wherein the connector is an electrical connector.

Item 9 is the connector of item 8, wherein the first body includes a plurality of terminals configured to contact corresponding terminals of a mating connector.

Item 10 is the connector of item 1, wherein the connector is a fiber optic connector.

Item 11 is the connector of item 1, wherein when the second body is in the first state, the first and second channels form a substantially continuous channel.

Item 12 is the connector of item 1, wherein when the second body is in the first state, the first and second channels form a substantially continuous and uniform channel.

Item 13 is the connector of item 1, wherein the first and second channels have lateral cross-sections having substantially the same size and shape.

Item 14 is the connector of item 1, wherein the first body is adjacent the second body.

Item 15 is the connector of item 1, wherein the second body defines an opening extending therethrough for receiving a cable.

Item 16 is the connector of item 1, wherein the second body is configured to move between first and second states by rotating along an axis substantially parallel to the mating direction.

Item 17 is a connector comprising:

a first channel;

a latching member, a first portion of which is slidably attached to the first channel; and a second channel configured to align with the first channel to form a substantially continuous channel to allow the latch member to latch with and unlatch from a mating connector, and to misalign with the first channel to prevent the latching member from latching with and unlatching from a mating connector.

Item 18 is the connector of item 17, wherein the connector is an electrical connector.

Item 19 is the connector of item 17, wherein the connector is a fiber optic connector.

Item 20 is the connector of item 17, wherein the first and second channels have lateral cross-sections having substantially the same size and shape.

Item 21 is the connector of item 17, further comprising a first body, the first body including the first channel, and a second body adjacent the first body, the second body including the second channel.

Item 22 is the connector of item 21, wherein the second body defines an opening extending therethrough for receiving a cable.

Item 23 is the connector of item 21, wherein the first channel extends along only a portion of a length of the first body.

Item 24 is the connector of item 21, wherein the first channel extends along an entire length of the first body.

Item 25 is the connector of item 21, wherein the first body is rotatably attached to the second body.

Item 26 is the connector of item 21, wherein the first body includes a larger first portion removably assembled to a smaller second portion, the second portion including a mating end.

Item 27 is the connector of item 26, wherein the first channel extends along an entire length of the first portion.

Item 28 is the connector of item 26, wherein when the second channel is aligned with the first channel, the second body and the first portion have lateral cross-sections having substantially the same size and shape.

Item 29 is the connector of item 21, wherein the latching member includes a second portion fixedly attached to the first body.

Item 30 is the connector of item 21, wherein the connector is an electrical connector.

Item 31 is the connector of item 30, wherein the first body includes a plurality of terminals configured to contact corresponding terminals of a mating connector.

Item 32 is the connector of item 21, wherein when the second body is in a first state, the first and second channels align and when the second body is in a second state, the first and second channels misalign.

Item 33 is the connector of item 32, wherein the second body is configured to move between first and second states by rotating along an axis substantially parallel to a mating direction.

Item 34 is the connector of item 32, wherein when the second body is in the first state, the first and second channels form a substantially continuous and uniform channel.

Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A connector comprising:

a first body including:

a mating end of the connector for mating with a mating connector, and a first channel extending along a mating direction of the connector;

a second body including:

a rear end of the connector opposite the mating end for receiving a cable, and a second channel extending along the mating direction;

a latching member disposed along the mating direction and including:

a fixed end fixedly attached to the first body proximate the mating end, a sliding end slidably attached to the first channel proximate the rear end, and an elongated latching arm joining the fixed end to the sliding end; and a latch portion extending from the latching arm for latching with and unlatching from a mating connector, the second body configured to move relative to the first body between first and second states, the second body in the first state aligns the second channel with the first channel so that when the latching arm is pressed the sliding end slides into the second channel allowing the latch portion to latch with and unlatch from a mating connector, the second body in the second state misaligns the second channel with the first channel so that when the latching arm is pressed the sliding end is prevented from sliding into the second channel preventing the latch portion from latching with and unlatching from a mating connector.

2. The connector of claim 1, wherein the mating direction is along a length of the connector between the mating and rear ends.

3. The connector of claim 1, wherein the first channel extends along only a portion of a length of the first body.

4. The connector of claim 1, wherein the first channel extends along an entire length of the first body.

5. The connector of claim 1, wherein the first body includes a larger first portion removably assembled to a smaller second portion, the second portion including the mating end.

6. The connector of claim 5, wherein the first channel extends along an entire length of the first portion.

7. The connector of claim 5, wherein when the second body is in the first state, the second body and the first portion have lateral cross-sections having substantially the same size and shape.

8. The connector of claim 1, wherein the connector is an electrical connector.

9. The connector of claim 8, wherein the first body includes a plurality of terminals configured to contact corresponding terminals of a mating connector.

10. The connector of claim 1, wherein the connector is a fiber optic connector.

11. The connector of claim 1, wherein when the second body is in the first state, the first and second channels form a substantially continuous channel.

12. The connector of claim 1, wherein when the second body is in the first state, the first and second channels form a substantially continuous and uniform channel.

13. The connector of claim 1, wherein the first and second channels have lateral cross-sections having substantially the same size and shape.

14. The connector of claim 1, wherein the first body is adjacent the second body.

15. The connector of claim 1, wherein the second body defines an opening extending therethrough for receiving a cable.

16. The connector of claim 1, wherein the second body is configured to move between first and second states by rotating along an axis substantially parallel to the mating direction.

17. A connector comprising:

a first channel, a latching member, a first portion of which is slidably attached to the first channel, and a second channel configured to align with the first channel to form a substantially continuous channel to allow the latching member to latch with and unlatch from a mating connector, and to misalign with the first channel to prevent the latching member from latching with and unlatching from a mating connector, wherein the first and second channels have lateral cross-sections having substantially the same size and shape.

18. The connector of claim 17, wherein the connector is an electrical connector.

19. The connector of claim 17, wherein the connector is a fiber optic connector.

20. The connector of claim 17, further comprising a first body, the first body including the first channel, and a second body adjacent the first body, the second body including the second channel.

21. The connector of claim 20, wherein the second body defines an opening extending therethrough for receiving a cable.

22. The connector of claim 20, wherein the first channel extends along only a portion of a length of the first body.

23. The connector of claim 20, wherein the first channel extends along an entire length of the first body.

24. The connector of claim 20, wherein the first body is rotatably attached to the second body.

25. The connector of claim 20, wherein the first body includes a larger first portion removably assembled to a smaller second portion, the second portion including a mating end.

26. The connector of claim 25, wherein the first channel extends along an entire length of the first portion.

27. The connector of claim 25, wherein when the second channel is aligned with the first channel, the second body and the first portion have lateral cross-sections having substantially the same size and shape.

28. The connector of claim 20, wherein the latching member includes a second portion fixedly attached to the first body.

29. The connector of claim 20, wherein the connector is an electrical connector, and wherein the first body includes a plurality of terminals configured to contact corresponding terminals of a mating connector.

30. The connector of claim 20, wherein when the second body is in a first state, the first and second channels align and when the second body is in a second state, the first and second channels misalign.

31. The connector of claim 30, wherein the second body is configured to move between first and second states by rotating along an axis substantially parallel to a mating direction.

32. The connector of claim 30, wherein when the second body is in the first state, the first and second channels form a substantially continuous and uniform channel.

* * * * *